United States Patent [19]

Roberts et al.

[11] Patent Number: 4,534,847

[45] Date of Patent: Aug. 13, 1985

[54] PROCESS FOR PRODUCING LOW-SULFUR BOILER FUEL BY HYDROTREATMENT OF SOLVENT DEASHED SRC

[75] Inventors: George W. Roberts, Emmaus; John C. Tao, Perkiomenville, both of Pa.

[73] Assignee: International Coal Refining Company, Allentown, Pa.

[21] Appl. No.: 571,311

[22] Filed: Jan. 16, 1984

[51] Int. Cl.[3] ..... C10G 1/00; C10G 1/06

[52] U.S. Cl. ..... 208/8 LE; 208/10

[58] Field of Search ..... 208/8 LE, 10; 44/1 B

[56] References Cited

U.S. PATENT DOCUMENTS

| | | | |
|---|---|---|---|
| 3,341,447 | 9/1967 | Bull et al. | 208/8 LE |
| 3,594,303 | 7/1971 | Kirk, Jr. et al. | 208/8 LE |
| 3,594,305 | 7/1971 | Kirk, Jr. | 208/10 |
| 3,884,796 | 5/1975 | Hinderliter et al. | 208/10 X |
| 3,892,654 | 7/1975 | Wright et al. | 208/8 LE |
| 4,045,328 | 8/1977 | Green et al. | 208/8 LE |
| 4,048,054 | 9/1977 | Green et al. | 208/8 LE |
| 4,075,079 | 2/1978 | Long | 208/8 LE |
| 4,097,361 | 6/1978 | Ashworth | 208/10 |
| 4,113,602 | 9/1978 | Gorbaty et al. | 208/10 X |
| 4,119,524 | 10/1978 | Leonard et al. | 208/8 LE |
| 4,123,347 | 10/1978 | Maa | 208/8 LE |
| 4,152,244 | 5/1979 | Raichle et al. | 208/8 R |
| 4,162,956 | 7/1979 | Rhodes | 208/8 LE |
| 4,191,700 | 3/1980 | Lebowitz et al. | 208/10 X |
| 4,251,346 | 2/1981 | Dry et al. | 208/8 LE |
| 4,260,472 | 4/1981 | Eisenlohr et al. | 208/8 LE |
| 4,356,077 | 10/1982 | Che | 208/8 LE X |
| 4,372,838 | 2/1983 | Kulik et al. | 208/8 LE X |
| 4,374,015 | 2/1983 | Brule | 208/8 LE |
| 4,410,414 | 10/1983 | Briley | 208/10 X |
| 4,440,622 | 4/1984 | Derbyshire et al. | 208/8 LE |

*Primary Examiner*—D. E. Gantz

*Assistant Examiner*—William G. Wright

[57] ABSTRACT

In this invention, a process is disclosed characterized by heating a slurry of coal in the presence of a process-derived recycle solvent and passing same to a dissolver zone, separating the resultant gases and liquid/solid products therefrom, vacuum distilling the liquid/solids products, separating the portions of the liquid/solids vacuum distillation effluent into a solid ash, unconverted coal particles and SRC material having a boiling point above 850° F. and subjecting same to a critical solvent deashing step to provide an ash-free SRC product. The lighter liquid products from the vacuum distillation possess a boiling point below 850° F. and are passed through a distillation tower, from which recycled solvent is recovered in addition to light distillate boiling below 400° F. (overhead). The ash-free SRC product in accompanyment with at least a portion of the process derived solvent is passed in combination to a hydrotreating zone containing a hydrogenation catalyst and in the presence of hydrogen is hydroprocessed to produce a desulfurized and denitrogenized low-sulfur, low-ash boiler fuel and a process derived recycle solvent which is recycled to slurry the coal in the beginning of the process before heating.

4 Claims, 1 Drawing Figure

PROCESS FOR PRODUCING LOW-SULFUR BOILER FUEL BY HYDROTREATMENT OF SOLVENT DEASHED SRC

The Government of the United States of America has rights in this invention pursuant to Contract No. DE-AC05-780R03054 (as modified) awarded by the U.S. Department of Energy.

This invention relates to coal conversion from high-sulfur, high-ash mined coal into low-sulfur, low-ash synthetic fuel by a direct liquefaction process. In particular, the invention provides an improved process for producing a low-sulfur, low-ash boiler fuel.

BACKGROUND OF THE INVENTION

Prior art solvent refined coal (SRC) technology is exemplified by U.S. Pat. No. 3,341,447. In the preferred embodiments of the invention the SRC process employed is known as SRC-I. In accordance with the present invention, solvent deashed SRC may be blended with process derived solvent and mildly hydrotreated to produce a low-sulfur, low-ash boiler fuel.

The basic SRC-I process requires coal-handling, pulverization of the coal in the range of 10 to 300 mesh and mixture, along with gaseous hydrogen, in a solvent that is hydroaromatic in nature and is capable of donating hydrogen to the coal particles. Solvent-to-coal ratios of between 1.5 parts and 3 parts of solvent to 1 part of coal are typically used. This mixture of solvent and coal plus hydrogen is pressurized to between about 500 to 3000 psig (35.1 to 210.8 kg/cm$^2$ gauge) and sent through a preheater, which heats the mixture to roughly 805° F. (429.4° C.). Some of the coal dissolves in the preheater.

The three-phase mixture then goes into a reactor, known as the dissolver. In the dissolver, additional dissolution, hydrogenation and desulfurization of coal occurs. The pressure of the dissolver is held close to 2000 psig (140.5 kg/cm$^2$ gauge), with a residence time conventionally ranging from two minutes up to two hours. During this time, coal is dissolved and hydrocracked, as bonds are broken and sulfur reacts with hydrogen to form $H_2S$. After the reaction, the three-phase effluent mixture is flashed and cooled, with gases being removed, including hydrogen, which may be recycled after purification. In one embodiment of the SRC-I process, the coal liquids and undissolved coal plus ash, after distillation to remove the 850° F.− fraction, go through a solvent deashing process, which is a liquid/solid separation step that separates ash and undissolved coal from the SRC and a heavy fraction of process derived solvent. The hydrogen-donating process-derived solvent fraction that was removed in the vacuum distillation step, e.g., the fraction boiling between about 400° F. and 850° F. is recycled to the front-end of the process. The 850° F.+ (429.4° C.+) boiling material may then be solidified as product; i.e., solvent refined coal which is also referred to by the acronym "SRC". The typical sulfur concentration in SRC is between about 0.7 and 1.5 weight percent, depending on the feed coal and the operating conditions. Total coal conversion on a moisture and ash-free basis is between 80% and 98%. The process has a hydrogen consumption of between about 1% to 3½% based on MAF (Moisture Ash Free) coal.

U.S. Pat. No. 4,374,015 discloses an SRC-I type process which employs a solvent deashing process of the type utilized in accordance with the invention. While a portion of the heavy soluble deashed SRC material (i.e., FIG. 1, line 68 of U.S. Pat. No. 4,374,015) is recycled to the front-end of the coal liquefaction process with optional hydrotreating for hydrogen enrichment in order to provide a portion of the solvent necessary to liquefy coal feed, the SRC material taken as product is not further treated to reduce sulfur or other heteroatoms.

In a variation of the SRC-I process, identified as SRC-II, a portion of the product slurry is recycled as a "solvent" for the coal rather than using an all-distillate liquid as in the original SRC-I process. In addition to dissolving the coal, the SRC-II process also converts much of the dissolved coal to distillate liquid and gaseous products. The major liquid product is separated in a vacuum distillation unit, the undistilled 850° F.+ product which is termed "vacuum residue", is fed to a gasifier for hydrogen production. In theory, the quantity of organic material remaining in the vacuum residue is controlled so that it is just sufficient to produce the hydrogen required for the process. Thus, conversion of a large part of the dissolved coal to liquids makes it possible to eliminate the liquid/solid separation step required in the SRC-I process. Hydrogen consumption is close to 5% in this SRC-II process.

Depending, in part, on the composition of the coal employed, the SRC produced from the SRC-I process may be too high in sulfur content, so that the $SO_2$ content of flue gases resulting from burning of the solid SRC product would not meet environmental standards. While the product produced by the modified SRC-II process has a lower sulfur content than that produced under the SCR-I, it is inherently more expensive than the SRC-I process, due to substantially larger hydrogen requirements. Also, the products of the SRC-II process are largely liquid rather than solid.

A number of coal conversion processes which involve a thermal liquefaction step, followed by a catalytic hydroprocessing step, have been developed.

The Consol Synthetic Fuel (CSF) Process has been demonstrated in a 20 ton/day pilot plant at Cresap, W. Va. In this process, preheated coal is slurried in a recycle solvent and reacted in a stirred vessel at low pressure (~500 psig, or 35.1 kg/cm$^2$ gauge) and at a temperature of 750° to 800° F. (398.9° to 426.7° C.). No hydrogen is added to the coal/solvent mixture prior to the reactor. The liquid products from the dissolver are passed through hydroclones to remove ash and unreacted coal. The solids stream from the hydroclone is coked at low temperature (ca. 900° F., or 482.2° C.) to produce a liquid stream and a char, which is gasified to produce hydrogen. The deashed products (vapor and liquid) from the dissolver, plus the liquid and gaseous products from the coking step, are sent to a separation section, where light gases, light distillate and recycle solvent are recovered. The bottoms product and the tars from the coking step are then hydrotreated. The hydrotreating conditions are relatively severe, such that most of the feed is converted to gas, naphtha and middle distillate. The small amount of residue that remains after this hydrotreating is typically used as a plant fuel. Because the hydrotreating step is so severe the product is essentially a distillate fuel.

The H-Coal Process, developed by Hydrocarbon Research, Inc., is generally regarded as a purely catalytic coal liquefaction process. However, it is likely that some small amount of "thermal" liquefaction takes place in the preheater upstream of the catalytic reactor. In this process, a slurry of coal, recycle solvent and hydrogen is passed through a fired preheater and is then fed to an ebullated-bed reactor which operates at about 850° F. (454.4° C.) and 2500 psig (175.7 kg/cm$^2$ gauge). In the reactor, the coal is liquefied and hydrocracked. Two modes of operation are possible, a "syncrude" mode and a "boiler fuel" mode. In the "syncrude" mode, severe hydrocracking takes place and the product is mostly distillate material. In the "boiler fuel" mode, the hydrocracking severity is less, and a substantial quantity of solid product is produced. However, this product has relatively high sulfur concentration, about 1 weight percent. Neither mode produces the desired product in a substantial yield, and the residence time for the thermal step is probably too low to accomplish much desulfurization or breakdown of coke precursors.

The Synthoil Process, developed by the U.S. Bureau of Mines, is similar to the H-Coal Process, except that hydroprocessing is carried out in a fixed-bed reactor, rather than an ebullated-bed reactor. As with H-Coal, some coal conversion probably takes place as the coal/recycle solvent/hydrogen slurry is passed through the preheater prior to the reactor. The objective of the Synthoil Process is to convert coal essentially completely to distillate products. Therefore, the hydroprocessing reactor is operated at a high severity.

The Exxon Doner Solvent (EDS) Process also involves both a thermal liquefaction step and a catalytic hydroprocessing step. The thermal liquefaction step is carried out at conditions very similar to those used for the SRC process. However, the recycle solvent is specially selected and catalytically hydrogenated in order to substantially increase its hydrogen-donor capacity. In the thermal liquefaction step, coal is converted essentially to liquid products, with only a small amount of heavy residue remaining. The effluent from the thermal step is distilled. One of the cuts is the recycle solvent, which is catalytically hydrotreated to increase its hydrogen-donor capacity, as noted above. The bottoms from the distillation step are coked or gasified to produce the hydrogen required for catalytic hydrotreating of recycle solvent and for the thermal liquefaction step.

However, this process differs from the present invention in that (1) no residual (initial boiling point >850° F., or 454.4° C.) solid fuel is produced; heavy materials (initial boiling point >850° F., or 454.4' C.) are coked or gasified rather than being hydroprocessed into a low-sulfur boiler fuel, and (2) only middle distillate (400° to 850° F., or 204.4° to 454.4° C.) is hydrotreated; no residue is hydrotreated. p U.S. Pat. Nos. 3,594,303, 4,123,347 and 4,152,244 are illustrative of the coal solvation patent art showing a thermal solvent refining step followed by a catalytic hydroprocessing step. These processes are directed, however, to maximizing the production of liquid hydrocarbons from coal and not the production of desulfurized and deashed solid boiler fuel as a primary product. U.S. Pat. Nos. 3,884,796 and 3,892,654, also show two stage systems, with the second stage comprising hydrogenation; however, the products are separated by distillation and filtration without further hydrogenation.

Among the objects of this invention are to provide a new and improved process for producing a boiler fuel from solvent refined coal having very low sulfur and ash content by a two-stage process with minimal hydrogen consumption having a first thermal solvent refining step and a second hydrotreating step, which produces desulfurization and denitrogenation without substantial reduction in asphaltene and preasphaltene levels or substantial coking.

SUMMARY OF THE INVENTION

This objective is achieved in accordance with the improved process of the present invention which is characterized by heating a slurry of coal in process-derived recycle solvent in a dissolving zone under pressure in the presence of hydrogen, separating the resulting gaseous and liquid/solids products, vacuum distilling the liquid/solids products, subjecting the portions comprising solid ash, unconverted coal particles and SRC material having a boiling point above 850° F. (454.4° C.) to a critical solvent deashing step to provide an ash-free SRC product, passing the liquid distillates having a boiling point below 850° F. (454.4° C.) to a distillation tower, separating recycle solvent from the light distillate boiling below about 400° F. (204.4° C.), conveying the ash-free SRC product to a hydrotreating zone where, in combination with a portion of said recycle solvent, under elevated temperature and pressure and in the presence of hydrogen and a hydrogenating catalyst, further hydroprocessing takes place under appropriate conditions to effect desulfurization and denitrogenation, without substantial reduction of asphaltene and preasphaltene levels or coking. The effluent is treated to separate the products which include a low-sulfur, low-ash boiler fuel as one primary product.

BRIEF DESCRIPTION OF THE DRAWING

The single FIGURE in the drawing shows a schematic flow diagram of the preferred embodiment of the invention.

Figure 1:
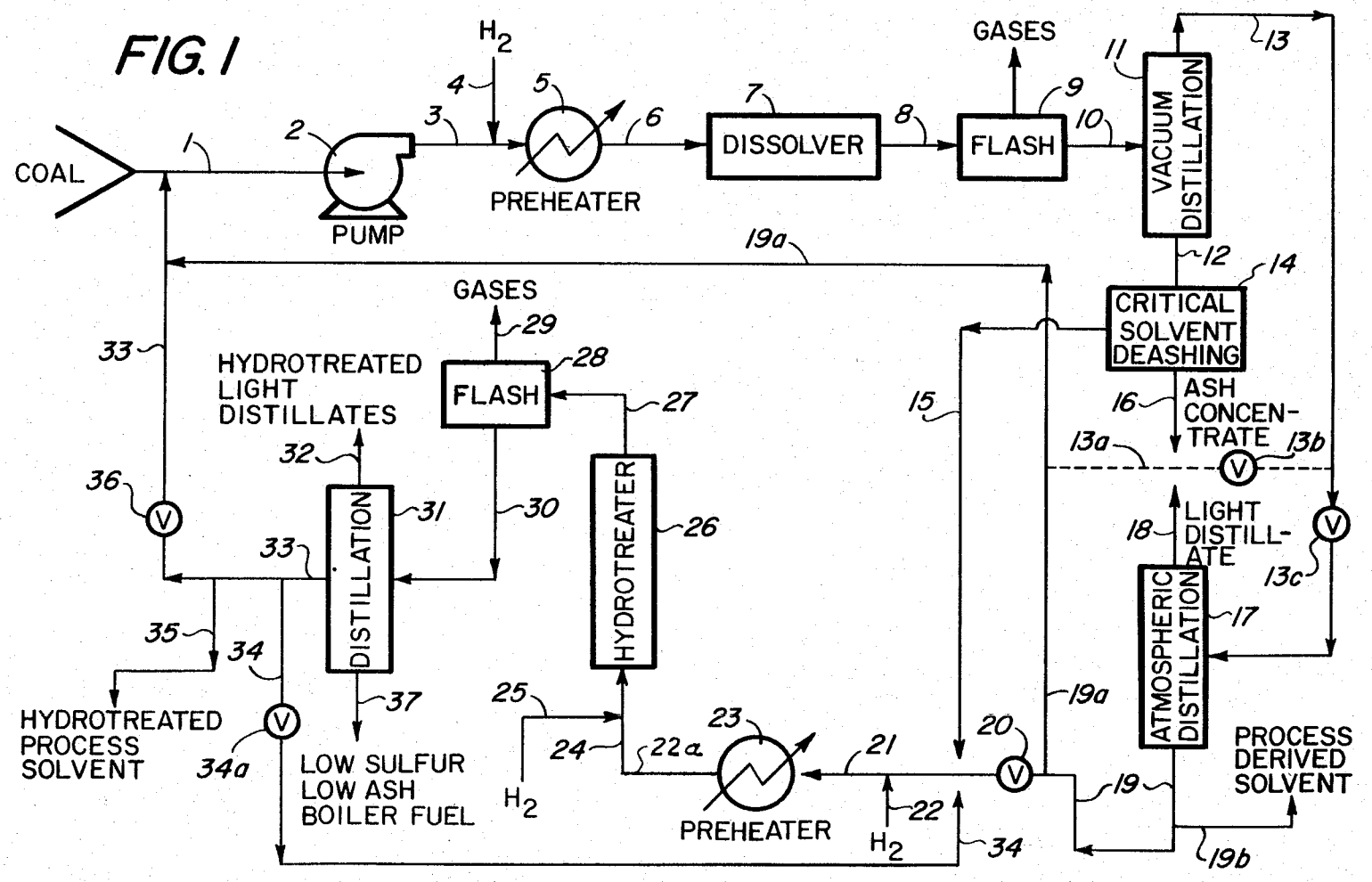

DESCRIPTION OF THE PREFERRED EMBODIMENT AND BEST MODE CONTEMPLATED FOR PRACTICING THE INVENTION

Ground coal, typically of about 10–300 mesh, is slurried with recycle solvent having a boiling range of about 400°–850° F. (204.4°–454.4° C.) in line 1. The coal concentration in the slurry may range from about 20 to 50% by weight, but typically about a 40% concentration is employed. At the lower concentrations, the coal throughout becomes uneconomically low while at the higher concentrations the viscosity in subsequent stages becomes too high for convenient processing.

The coal slurry in 1 is led into pump 2 where it is pressured to a range of about 500 to 3000 psig (35.1 to 210.8 kg/cm$^2$ gauge). The slurry exits pumps 2 via line 3 and a hydrogen containing gas is added to the slurry at 4 in an amount such that the $H_2$/coal weight ratio is in the range of about 0.025 to 0.15. The $H_2$/coal/recycle solvent mixture is then preheated in preheater 5 to a temperature of about 750° F. (398.9° C.). Some dissolution of the coal in the recycle solvent takes place in the preheater.

The preheated hydrogen/coal/recycle solvent mixture is then fed via line 6 into dissolver vessel 7. This vessel has an outlet temperature in the range of about 750° to 900° F. (398.9° to 482.2° C.) and residence time of the reactants in the dissolver is generally in the range of 5 to 60 minutes.

The coal and recycle solvent undergo a number of chemical transformations in dissolver 7, including but not necessarily limited to; further dissolution of the coal in the liquid, hydrogen transfer from the recycle solvent to the coal, rehydrogenation of recycle solvent, removal of heteroatoms (S, N, O) from the coal and recycle solvent, reduction of certain components of the coal ash, (e.g. $FeS_2$ to FeS), and hydrocracking of heavy coal liquids. This step is frequently referred to as "thermal" solvent refining, although the mineral matter in the coal can, in various extends, catalyze the above reactions.

The dissolver contents are removed via line 8 and fed into a flash separating zone shown generally at 9, where the dissolver effluent is flashed to remove overhead light gases, e.g. $H_2$, $H_2S$, $CO_2$, $NH_3$, $H_2O$ and $C_1$–$C_4$ which are cooled to about 100° to 150° F. (37.8° to 65.6° C.) to condense water and light hydrocarbons. The gases may be scrubbed to remove acidic or alkaline components, and the hydrogen and/or lower hydrocarbons may be recycled to various stages in the process or burned for fuel. The remaining effluent from the flash separating zone has a temperature of about 500° F. (260° C.) and consists of liquid/solid slurry which is fed via line 10 to vacuum distillation column 11 where it is vacuum distilled.

Substantially all of the solid ash and undissolved coal particles and SRC that boils above about 850° F. (454.4° C.) is separated from the lighter liquids boiling below about 850° F. (454.4° C.) and are removed from vacuum distillation column via line 12. From line 12, these materials are passed to the critical solvent deashing unit 14, in which solid ash and undissolved coal particles referred to as "ash concentrate", are separated and removed via line 16. The critical solvent deashed SRC product (CSD-SRC) is separated in the critical solvent deashing unit and recovered via line 15.

The lighter liquids boiling at less than about 850° F. (454.4° C.) are removed from the vacuum distillation column 11 via line 13 and passed into distillation tower 17. While one distillation tower is shown, it is obvious that more may be employed. In tower 17, the lighter liquids are separated into two streams; (a) light distillates (up to about 400° F., or 204.4° C., boiling point) and (b) process derived recycle solvent (boiling range of about 400° to 850° F., or 204.4 to 454.4° C.) A first portion of the process derived recycle solvent, generally referred to as "process solvent", is produced in tower 17 and recycled via line **19*a*** to the coal feed to help make the initial coal/recycle solvent slurry.

The light distillates are removed from distillation tower 17 via line 18, and a second portion of process solvent is removed via line **19*b*. CSD-SRC from the critical solvent deashing unit 14 is introduced via line 15 into a third portion of process solvent in line 21, the flow of which is controlled by valve 20. This combined flow of process solvent and deashed SRC is pressurized with hydrogen introduced at 22 to a pressure of about 700 to 3000 psig (49.2 to 210.8 kg/cm$^2$ gauge) to form a mixture having an $H_2$/liquid ratio in the range of about 500 to 10,000 scf/bbl, preferably 2000 to 10,000 scf/bbl. The $H_2$/liquid mixture is then preheated to a temperature of about 400° F. to 800° F. (204.4° to 426.7° C.) in preheater 23 and is fed via line 22*a* into catalytic hydrotreater 26. The liquid hourly space velocity in hydrotreater 26 may range from 0.1 to 5.0 volumes liquid/volume of catalyst/hour. Additional $H_2$ containing gas may be introduced via line 25**. The hydrogenation catalyst treatment stage is preferably fixed bed (upflow or downflow mode), but may also employ an expanded bed, or entrained catalyst. Any hydrogenation catalyst may be employed in the hydrotreater, but a class found useful is a mixture of a sulfided Group VI B and Group VIII metals on alumina or silica stabilized alumina. The hydrotreating catalyst must be selected so that the required amount of desulfurization of SRC is achieved with a minimum consumption of hydrogen. In addition, the hydrocracking activity of the catalyst should be minimal. A cobalt molybdate or nickel molybdate catalyst on a silica stabilized alumina support meets these requirements.

Typically, the hydrotreater is operated close to adiabatically. The inlet temperature of the hydrotreater is adjusted to produce a hydrotreated SRC product having the sulfur content desired, typically less than 0.5 weight percent. By elevating the temperature, the sulfur content of the product is reduced, other conditions being equal. Also as the catalytic activity decreases with time on stream the inlet temperature of the hydrotreater is periodically adjusted upwards to compensate for the loss of activity.

The effluent from the hydrotreater is fed via line 27 to a flash separating zone shown generally at 28 where the effluent is flashed in one or more stages to separate light gases removed via line 29. Such gases may be treated in a manner like gases from 9. The remaining liquid is then fed from flash zone 28 via line 30 to distillation tower 31. There it is distilled in one or more stages to produce at least three streams; light distillates 32 (final boiling point about 400° F., or 204.4° C.), process derived recycle solvent (boiling range about 400° to 850° F.) 33 containing a very low level of ash (typically $<0.1$ weight percent, or 204.4° to 405.4° C.) and a low level of sulfur (typically $<0.5$ weight percent), and a low-sulfur low-ash boiler fuel 37, which is typically a solid at ambient temperature.

The recycle solvent of stream 33 is returned to the beginning of the process in conduit 1 for use in forming the coal/recycle solvent slurry, or may be recycled to the hydrotreater or may be withdrawn as net product through conduit 35 or it may be recycled via conduit 34 and valve **34*a* for admixture with the deashed SRC product from CSD in 14 provided by conduit 15 and extrinsic hydrogen in 22**. Any excess recycle solvent, light gases and light distillates produced in the process are used as a fuel or for petro-chemical values.

Optionally, some of the second recycle solvent recovered from distillation tower 31 may be fed into the hydrotreater zone 26. Another option in the process is the elimination of the distillation step in tower 17, and passage of the liquid product from vacuum distillation column 11 directly for combination with CSD-SRC from line 15, for pressurization with hydrogen containing gas 22 and preheating in preheater 23 to the temperature, pressure and $H_2$/liquid ratio, prior to passage to the hydrotreating step, as previously set forth.

As will be apparent to one skilled in the art, various streams in the process can be heat exchanged to make the process more energy efficient. Also, the various products separated from the flasher stages and distillation stages may be recycled as appropriate to other stages in the process. The hydrocarbon rich streams may be used to generate hydrogen for use in the process or they may be used as fuel.

An important aspect of the process of the invention is that the SRC produced in the thermal liquefaction step is deashed by a solvent deashing process, and preferably the critical solvent deashing (also referred to as "CSD") process developed by Kerr-McGee Corporation of Oklahoma City, Okla. The resulting deashed SRC material provides a substantially better feedstock for catalytic hydrotreating for purposes of the invention, than SRC materials deashed by alternative deashing methods, such as the filtration, hydrocloning, centrifugation or like processes. The CSD-SRC material, when blended with a portion of the 400° to 850° F. (204.4° to 454.4° C.) distillate from the distillation column, provides a hydrotreater feedstock which, when subjected to the mild hydrotreating conditions in accordance with the invention is capable of yielding a low-sulfur, low-ash solid boiler fuel, without substantial reduction in asphaltene and preasphaltene levels and also without substantial coking. This hydrotreater feedstock facilitates production of a 850° F.+ (454.4° C.+) SRC product which can advantageously and economically be removed as a boiler fuel product, rather than recycled for further hydrotreating (with accompanying increased hydrogen consumption) as has been taught in the prior art, to yield increased quantities of ligher distillate product.

Another important aspect of the process of this invention is the capability to produce a low-sulfur, low-ash, boiler fuel without substantial reduction in asphaltene and preasphaltene levels, wherein in the hydrogen consumption in the dissolver relative to that in the catalytic hydrotreater is minimized. Of course, it is possible to produce a heavy boiler fuel with equivalently low sulfur levels by either thermal solvent refining alone (i.e., without subsequent catalytic hydrotreating) or by catalytic hydrocracking alone (i.e., with little or no prior thermal solvent refining).

However, when thermal solvent refining alone is used to produce a boiler fuel with less than about 0.5 weight percent sulfur, an excessively high consumption of hydrogen results. This is believed to be due to the fact that the coal minerals which catalyze the various reactions involved are not particularly selective for the desulfurization reactions. In the process of desulfurizing the dissolved coal to a very low level by thermal solvent refining, a great deal of undesired hydrocracking results. In fact, the process for producing a heavy boiler fuel containing less than about 0.5 weight percent sulfur (the SRC-II process) involves so much hydrocracking that only a minimal amount of solid boiler fuel is produced; most of the original coal is hydrocracked to distillate products and gases in this process. The large amount of hydrogen consumed in this process imposes a severe economic penalty.

Purely catalytic processes can also be used to produce a low-sulfur, solid boiler fuel. However, the processes that exist today are all oriented towards producing primarily distillate (final boiling point <850° F. (<454.4° C.)) products and therefore involve high hydrogen consumptions. Examples of such processes are the H-Coal process and the Synthoil process. The H-Coal process can be operated in a "boiler fuel" mode, where substantial amounts of solid boiler fuel are produced. However, when the feed coal is a high-sulfur coal, the boiler fuel has a sulfur concentration in the vicinity of 1 weight %, and is therefore not as environmentally acceptable as the product of this invention which produces a low-sulfur boiler fuel from a high-sulfur feed coal.

Both the H-Coal and Synthoil processes suffer from very rapid deactivation of the heterogeneous catalysts that are used to accelerate the liquefaction and desulfurization reactions. The reasons for this catalyst deactivation are not presently well understood. However, the two primary causes are believed to be: (1) blocking of the active sites on the catalyst surface by mineral matter contained in the coal, and; (2) carbon deposition on the catalyst surface, resulting from exposure of the catalyst to very hydrogen-deficient molecules which result from initial coal dissolution. In both the Synthoil and H-Coal processes, the catalyst loses a significant amount of its initial activity in the first several hundred hours.

The problem of ash deposition on the active catalyst surface may be mitigated to some extent by proper reactor design, e.g., by use of an ebullating bed, as in the H-Coal process, where the catalyst particles are in constant motion and the ash apparently is continually abraded and washed from the external catalyst surface. The problem of carbon deposition is intrinsic to all primary liquefaction processes which employ catalysts. In the H-Coal process, this problem is controlled to some extent by operating the liquefaction reactor in a highly backmixed mode, and operating at conditions that produce a significant amount of hydrogenation and hydrocracking of the coal molecules. Thus, the catalyst is always exposed to a coal liquid which has a relatively high hydrogen/carbon ratio, and is therefore less prone to decompose to coke on the catalyst surface. However, the penalty for avoiding coke formation in this manner is a very high hydrogen consumption, of the same order as that in the SRC-II process and significantly higher than that in the invention herein described.

It should be noted that purely thermal or purely catalytic processes produce very low yields of solid (at room temperature) boiler fuel containing less than about 0.5 weight percent sulfur from high-sulfur feed coal. At this degree of desulfurization, most of the products from such processes are liquid.

The process of this invention employs both a thermal solvent refining step, followed by an ash removal step, and then a mild catalytic desulfurization step to realize the benefits of a selective catalytic desulfurization, without the concomitant disadvantages of rapid catalyst deactivation or excess hydrogen consumption. The first thermal solvent refining step serves to: (1) solubilize the coal to permit ash removal; (2) remove many of the unstable molecules that would lead to rapid coke formation on a catalyst surface, and; (3) remove some of the sulfur from the coal, so that milder and more selective operating conditions can be employed in the catalytic hydrotreater.

To realize the significant benefits of this invention, the thermal solvent refining step is designed and operated so as to be synergistic with the catalytic desulfurization step. If too little reaction takes place in the dissolver, ash removal from the dissolver effluent will be difficult. More importantly, however, the catalyst in the hydrotreater will deactivate rapidly due to coke deposition. This rapid coke deposition will result from: (1) the presence of coke precursors which were not converted into more stable molecules in the dissolver, due to overly mild operating conditions, and (2) the need to operate the hydrotreater at a higher temperature in order to remove excessive amounts of sulfur which were not removed in the dissolver. High hydrotreater temperatures not only increase the rate of coke laydown, but also cause the catalyst to operate less selectively.

On the other hand, it is obvious that if too much of the desulfurization is accomplished in the dissolver, then only minor benefits in hydrogen consumption will be obtained in the subsequent, selective catalytic hydrodesulfurization.

The proper distribution of desulfurization duty between the dissolver and the catalytic hydrotreater can be defined by the hydrogen consumption in the dissolver relative to the catalytic hydrotreater. In order to gain a significant benefit from this invention, the hydrogen consumption in the dissolver should not be less than about 25 percent, and not more than about 80 percent of the total hydrogen consumption for the overall process.

EXAMPLE

The following example illustrates one embodiment of the invention, which it is to be understood is not limited thereto. Kentucky Colonial coal of the composition shown in Table 1 is ground to less than 200 mesh and dried to remove some of the moisture.

TABLE 1

| Analysis of Feed Coal | | | |
|---|---|---|---|
| Proximate Analysis | (Wt %) | Ultimate Analysis | (Wt %) |
| moisture | 1.4 | Carbon | 69.7 |
| volatile matter | 35.8 | Hydrogen | 4.8 |
| fixed carbon | 54.1 | Nitrogen | 1.1 |
| ash | 8.7 | Sulfur | 3.7 |
| | | Oxygen | 12.2 |
| | | Ash | 8.5 |

The dry coal feed rate is about 549 lb/hr (249.0 kg/hr). This dehumidified coal is slurried with about 959 lb/hr (435 kg/hr) of process derived recycle solvent. The slurry is then pumped to a pressure of about 2200 psig and a hydrogen-rich gas is added at a rate of about 330 lb/hr (149.7 kg/hr). This gas contains about 85 mole percent $H_2$, and the actual $H_2$ feed rate is about 37.2 lb/hr (16.9 kg/hr). The ratio of $H_2$ fed to moisture and ash free (MAF) coal is about 24,125 scf $H_2$/ton coal.

The $H_2$-containing slurry is passed through a preheater. The slurry leaves the preheater at a temperature of approximately 750° F. (398.9° C.) and then passes directly into a dissolver and reacts for a residence time period of 36 minutes. The pressure in the dissolver is approximately 2100 psig, and the temperature varies from about 750° F. (398.9° C.) at the dissolver inlet to about 840° F. (448.9° C.) at the dissolver outlet, with most of this rise occurring in the first third of the dissolver.

The material leaving the dissolver is depressurized in flash separator. The evolved $H_2$-rich gas is scrubbed with diethanol amine to remove $H_2S$ and $CO_2$. A small portion of the scrubbed gas is purged and the balance is recycled to the inlet of the dissolver. The consumption of $H_2$ in the dissolver is estimated to be about 2.4 weight percent, based on the feed of MAF coal. This translates to about 12 lb (5.4 kg) $H_2$/hr or about 9065 scf/ton of MAF coal. The liquid stream from the flash separator is then fed to a vacuum distillation column, where it is vacuum distilled to produce lighter liquids (BP less than 850° F., or 454.4° C.) and vacuum still bottoms (BP above 850° F., or 454.4° C.) which contains solid ash, undissolved coal particles and SRC. The lighter liquids are passed to a distillation column, as discussed below, while the vacuum still bottoms are fed to the critical solvent deashing unit.

The critical solvent deashing process used is the Kerr-McGee critical solvent deashing ("CSD") process, as described in U.S. Pat. No. 4,119,523, all of the teaching of which are hereby incorporated by reference. The vacuum distillation still or tower is typically operated at a pressure from about 1 to 5 psia (0.07 to 0.35 kg/cm$^2$) and a bottom temperature of about 500° to 700° F. (260° to 371.1° C.). Light liquids can be recovered either from this tower or a downstream distillation system. A process derived recycle solvent can also be obtained and recycled to be used to slurry the feed coal.

In the CSD process, the hot vacuum still bottoms, which contain dissolved carbonaceous product, minerals, and unconverted coal macerals, plus a small amount of residual process solvent, are transferred to a deashing mix tank to which is added the critical deashing solvent. The weight ratio of deashing solvent to vacuum still bottoms should range from about 1 to 10.

After complete mixing, the resulting slurry is introduced into a first separator at a pressure ranging from almost 750 to about 1000 psig (52.7 to about 70.3 kg/cm$^2$ gauge), at a temperature from about 450° to 630° F. (232.2° to 332.2° C.). Two phases separate; (1) a light phase comprising primarily deashing solvent and SRC, and (2) a heavier phase comprising primarily solid insoluble mineral ash, undissolved coal, dissolved coal, and a small amount of deashing solvent. The heavy phase is withdrawn from the lower portion of the separator. Deashing solvent is flashed off and passed to the deashing mix tank. The remaining solid, insoluble ash, undissolved coal and the dissolved coal, referred to jointly as "ash concentrate", is removed from the system and passed to equipment for hydrogen generation, preferably a gasifier.

The light phase formed in the first separator is withdrawn and passed into a second separation vessel. Here, the temperature of the light phase is increased from about 600° to about 850° F. (315.6° to about 454.4° C.), and preferably from about 630° to about 700° F. (332.2° to about 371.1° C.), while the pressure is usually maintained at about 750 to 1000 psig (52.7 to about 70.3 kg/cm$^2$ gauge), as a result of which separation occurs with a light phase rising to the top of the second separator vessel and a heavy phase settling to the bottom. The heavy phase is withdrawn by reduction in pressure. Deashing solvent is flashed off and recycled for reintroduction into the critical solvent deashing system. The remaining solvent-free heavy phase material is molten deashed SRC product, or CSD-SRC.

The CSD-SRC leaving the critical solvent deashing stage has the composition given in Table 2.

TABLE 2

| Deashed SRC Composition | |
|---|---|
| Ultimate Analysis (wt %) | |
| Carbon | 86.72 |
| Hydrogen | 6.03 |
| Nitrogen | 2.09 |
| Sulfur | 1.12 |
| Oxygen | 3.99 |
| Ash | 0.05 |
| Density (20/4° C.) (gr/cc) | 1.221 |
| Benzene Insolubles (wt %) | 26.8 |
| Heptane Insolubles (wt %) | 82.6 |

The lighter liquids passed from the vacuum distillation column to the atmospheric distillation tower are distilled to separate light distillates (BP up to about 400° F., or 204.4° C.) and process solvent (BP range of 400°–850° F., or 204.4°–454.4° C.). The CSD-SRC is combined with an equal volume of process solvent from the distillation tower and this liquid mixture is pumped to a pressure of about 2000 psig (140.5 kg/cm$^2$ gauge), with a hydrogen-rich gas being added such that the ratio of $H_2$ to liquid mixture is about 7500 scf/bbl. This hydrotreater feed is preheated to a temperature of about 780° F. (415.6° C.) and is passed upflow through a fixed bed of Ketjenfine 153-S nickel molybdate catalyst, at a rate such that the liquid hourly space velocity (LHSV) is about 1.0 volumes liquid/volume catalyst, hr. The important properties of this catalyst are given in Table 3.

TABLE 3

| Catalyst Properties | |
|---|---|
| Form | 1/16" diameter extrudate |
| Composition (wt %) | |
| NiO | 3.0 |
| $MoO_3$ | 15.0 |
| Support | silica-stabilized alumina |
| Pore Volume | 0.55 cc/gr |
| Surface Area | 250 $m^2$/gr |

The heat liberated by the catalyzed reaction causes the temperature to increase along the length of the reactor.

The stream leaving the hydrogenation reactor is cooled to about 400° F. and is then depressurized in several stages. The hydrogen-rich gases collected are scrubbed to remove contaminants, mainly hydrogen sulfide and ammonia. After removal of a small purge stream to prevent buildup of light hydrocarbon gases, the hydrogen-rich gas stream is recycled to the hydrotreater inlet.

The liquid products collected in the separation system are distilled to produce three hydrocarbon streams with different boiling ranges: (1) <400° F. (204.4° C.); (2) 400° to 850° F. (204.4° to 454.4° C.), and (3) 850+° F. (454.4+° C.). The <400° F. stream may be used for fuel, as may be the hydrogen-rich gas stream that is obtained during the depressurization steps. Alternatively, either or both of these streams may be used to generate hydrogen. These light hydrocarbons amount to about 2.5 weight percent of the original deashed SRC.

The 850+° F. (454.4° C.) stream amounts to 36 wt percent of the original CSD-SRC, stream, giving a yield of about 71 wt percent based on 850+° F. (454.4+° C.) material fed to the hydrotreater. The total yield of heavy boiler fuel, with a boiling point in excess of 850° F. (454.4° C.), is about 37 weight percent based on MAF coal fed to the dissolver.

The concentration of sulfur in the 850+° F. (454.4+° C.) material leaving the hydrotreater is 0.38 wt percent.

Exclusive of hydrogen taken up by the process solvent, the hydrogen consumed in the hydrotreater is about 0.71 lb/100 lb hydrotreater feed, or about 0.75 percent, based on MAF coal. Thus, the total $H_2$ consumption is about 3.1 wt percent, based on MAF coal. About 26% of this consumption occurs in the hydrotreater, and about 74% occurs in the dissolver.

The properties of the separated 850° F.+ (454.4° C.+) fraction (i.e., low-sulfur, low-ash solid boiler fuel) are as follows:

Initial boiling point >750° F., (>398.9° C.) final boiling point >850° F. (>454.4° C.), carbon content >85 wt. %, ash content >0.3 wt. %, sulfur content <0.6 wt. %, hydrogen content >7.0 <8.5 wt. %, softening point <200° F. (<93.3° C.), benzene insolubles <25 wt. %, oxygen content <3.5 wt. %.

Although the preceding example is presented solely for purposes of illustration, it will be understood by those skilled in the art that the improved process of the invention may be varied, altered or modified without departing from the spirit or scope of the invention as defined in the appended claims.

We claim:

1. An improved process for producing a substantially ash-free, low-sulfur solid boiler fuel by hydrotreating deashed solvent refined coal wherein hydrogen consumption and the occurrence of coking in said hydrotreating step are minimized, said process comprising:

(a) mixing finely divided coal with a hydrogen donor solvent for the hydrocarbonaceous material in said coal, said solvent having a boiling range of about 400° F. to 850° F. (204.4° to 454.4° C.), to form a slurry, (b) pressurizing said slurry to a pressure of between 500 and 3000 psig (70.3 to 210.8 kg/$cm^2$ gauge), (c) adding a gas comprising molecular hydrogen to the pressurized slurry to form a hydrogen-containing slurry having a hydrogen/coal weight ratio of about 0.025 to 0.15, (d) preheating said hydrogen-containing slurry to about 750° F. (398.9° C.), (e) passing the heated hydrogen-containing slurry to a dissolving zone having an outlet temperature in the range from about 750° F. to 900° F. (398.9° to 482.2° C.), (f) maintaining said heated hydrogen-containing slurry in said dissolving zone for a residence time of about 2 to 120 minutes, (g) removing the treated slurry as effluent from said dissolving zone and passing the same to a first flash separating zone to reduce the pressure and to cool said effluent, (h) removing overhead light gases comprising $H_2$, $H_2S$, $NH_3$, $H_2O$ and $C_1$ to $C_4$ hydrocarbons from said first flash separating zone, (i) removing the flashed effluent from said first flash separating zone and passing the same to a vacuum distillation zone, (j) vacuum distilling said flashed effluent to separate a first portion having an initial boiling point below about 850° F. (454.4° C.) and a second portion having an initial boiling point above about 850° F. (454.4° C.), (k) removing said first portion from said vacuum distillation zone and passing the same through a distillation zone to separate a light distillate fraction and a process derived solvent fraction, (l) removing said second portion from said vacuum distillation zone and passing the same through a critical solvent deashing zone to produce deashed solvent refined coal having a boiling point greater than 850° F. consisting predominantly of asphaltenes and preasphaltenes and having a hydrogen content of less than 6.5% and ash concentrate comprising solid ash and undissolved coal, (m) removing said deashed solvent refined coal having a boiling point greater than 850° F. consisting predominantly of asphaltenes and preasphaltenes and having a hydrogen content of less than 6.5% from said critical solvent deashing zone and combining same with at least a portion of said process solvent from said first distillation zone to produce a hydrotreater feedstock stream, (n) pressurizing said hydrotreater feedstock stream with hydrogen and adjusting the temperature of said stream to from about 400° F. to 800° F. (204.4° to 426.7° C.), (o) passing said preheated hydrotreater feedstock stream containing said preasphaltenes and asphaltenes to a hydrotreating zone containing a sulfided hydrotreating catalyst at hydrogenation conditions including a temperature of from 650° F. to 850° F. (343.3° to 454.4° C.) and a pressure ranging from about 1000 to 2500 psig (70.3 to 175.7 kg/cm$^2$ gauge) for a sufficient time effective to produce a liquid hydrotreating effluent containing a solid boiler fuel at room temperature, without substantial reduction in said asphaltene and preasphaltene levels and without substantial coking, wherein said hydrotreating is effective to desulfurize and denitrogenate said preheated hydrotreated feedstock stream, (p) removing the hydrotreated liquid effluent from said hydrotreating zone and passing the same to a second flash separating zone to reduce the pressure and temperature of said effluent and to separate light gases therefrom and, (q) removing the remaining portion of the flashed hydrotreated liquid effluent from said second flash separating zone and passing the same to a second distillate zone to separate a second light distillate stream, a second recycle solvent stream and a substantially ash-free low sulfur solid boiler fuel.

2. The improved method of claim 1 wherein said deashed solvent refined coal is produced in said critical solvent deashing zone by a process comprising:

(a) mixing said second portion from said vacuum distillation zone with critical deashing solvent in a critical solvent deashing mixing zone at temperatures ranging from 450° to 630° F. (232.2° to 332.2° C.) and pressures ranging from 750 to 1000 psig (52.7 to 70.3 kg/cm$^2$ gauge) to form a critical solvent deashing slurry, (b) passing said critical solvent deashing slurry into a first separator from which a first light upper phase and a first lower heavy phase are separated, (c) removing said first lower phase comprising primarily critical deashing solvent which is recovered and returned to said critical solvent deashing mixing zone, and an ash concentrate comprised of solid, mineral ash residue, and undissolved coal, (d) passing said first light upper phase to a second separator where in a light second phase comprised of critical deashed deashing solvent and a light fraction of solvent refined coal, and a second heavy phase comprised of solvent refined coal are separated and from which critical deashing solvent is isolated and recycled to said critical solvent deashing mix zone, and is isolated and recycled to said critical solvent deashing mix zone, and (e) isolating a heavy fraction comprising said deashed solvent refined coal.

3. The improved process of claim 1 wherein said hydrotreating zone comprises a fixed bed hydrotreater in which the said hydrotreater feedstock is passed upwardly through said bed.

4. The improved process of claim 1 wherein the hydrogen consumption in the dissolver zone is about 74% by weight and the hydrogen consumption in the hydrotreating zone is about 26% by weight of the total hydrogen consumption, exclusive of the hydrogen taken up by said process solvent.

* * * * *